US009713927B2

(12) United States Patent
Till

(10) Patent No.: US 9,713,927 B2
(45) Date of Patent: Jul. 25, 2017

(54) PRINTING PRESS FOR PRINTING THREE-DIMENSIONAL OBJECTS

(71) Applicant: Till GmbH, Kelkheim (Taunus) (DE)

(72) Inventor: Volker Till, Hofheim am Taunus (DE)

(73) Assignee: TILL GMBH, Kelkheim (Taunus) (DE)

( * ) Notice: Subject to any disclaimer, the term of this patent is extended or adjusted under 35 U.S.C. 154(b) by 0 days.

(21) Appl. No.: 15/021,713

(22) PCT Filed: Sep. 12, 2014

(86) PCT No.: PCT/EP2014/069551

§ 371 (c)(1),
(2) Date: Mar. 14, 2016

(87) PCT Pub. No.: WO2015/036571

PCT Pub. Date: Mar. 19, 2015

(65) Prior Publication Data

US 2016/0221360 A1 Aug. 4, 2016

(30) Foreign Application Priority Data

Sep. 13, 2013 (DE) ..... 10 2013 015 097

(51) Int. Cl.
*B41J 3/407* (2006.01)
*B41J 2/01* (2006.01)
(Continued)

(52) U.S. Cl.
CPC ..... *B41J 3/4073* (2013.01); *B41F 17/001* (2013.01); *B41J 2/01* (2013.01); *B41J 3/54* (2013.01); *B41J 29/40* (2013.01)

(58) Field of Classification Search
CPC ... B41J 3/4073; B41J 2/01; B41J 29/40; B41J 3/546; B41J 3/54; B41J 3/407; B41F 17/001
See application file for complete search history.

(56) References Cited

U.S. PATENT DOCUMENTS

2006/0137548 A1 6/2006 Vetter
2009/0205516 A1 8/2009 Till
(Continued)

FOREIGN PATENT DOCUMENTS

DE 2938026 A1 3/1981
DE 102007020635 A1 11/2007
(Continued)

*Primary Examiner* — Geoffrey Mruk
(74) *Attorney, Agent, or Firm* — Leydig, Voit & Mayer, Ltd.

(57) ABSTRACT

A printing press for digital printing on three-dimensional objects includes a plurality of printing stations arranged in a specified radian on an outer peripheral edge of a press wheel. Each one of the printing stations includes an inkjet print head for digital printing on three-dimensional objects and a rotary table for holding the three-dimensional object. A printing unit prints on the three-dimensional object by separate printing of a mark or a logo executed as a pad print. The printing unit includes a mechanical feed unit and a plurality of pads successively arranged on a rotating wheel. The pads and the surfaces of the printed three-dimensional objects held in the printing stations are held in the same radian and move at the same circumferential speed so that the pads print on the three-dimensional objects by means of a tampograph.

11 Claims, 3 Drawing Sheets

(51) Int. Cl.

| | |
|---|---|
| ***B41J 3/54*** | (2006.01) |
| ***B41J 29/40*** | (2006.01) |
| ***B41F 17/00*** | (2006.01) |

(56) References Cited

U.S. PATENT DOCUMENTS

| | | | | |
|---|---|---|---|---|
| 2010/0192517 | A1* | 8/2010 | Schach | B41J 2/0057<br>53/411 |
| 2013/0019566 | A1 | 1/2013 | Schach | |

FOREIGN PATENT DOCUMENTS

| | | | |
|---|---|---|---|
| DE | 102013208061 | A1 | 7/2013 |
| WO | WO 03106177 | A2 | 12/2003 |
| WO | WO 2009018892 | A1 | 2/2009 |

* cited by examiner

PRINTING PRESS FOR PRINTING THREE-DIMENSIONAL OBJECTS

CROSS-REFERENCE TO PRIOR APPLICATIONS

This application is a U.S. National Stage Application under 35 U.S.C. §371 of International Application No. PCT/EP2014/069551 filed on Sep. 12, 2014, and claims benefit to German Patent Application No. DE 10 2013 015 097.3 filed on Sep. 13, 2013. The International Application was published in German on Mar. 19, 2015 as WO 2015/036571 A1 under PCT Article 21(2).

FIELD

The invention relates to a printing press for printing three-dimensional objects. The proposed printing press is suitable, in particular, for digitally printing three-dimensional, rotationally symmetrical objects, such as bottles or cans.

BACKGROUND

For digital printing, the printing press has at least one inkjet print head or several inkjet print heads, with, for example, different printing inks such as Cyan (C), Magenta (M), Yellow (Y), and/or Black (K), and a rotary table for receiving the three-dimensional object, wherein the rotary table is configured for placing the object in front of the inkjet print head or several inkjet print heads, and for rotating it about the axis thereof, in order that the surface to be printed of the three-dimensional object is guided past the inkjet print head or the inkjet print heads for digital printing, in which the ink drops are sprayed onto the surface when required (drop-on-demand process).

Three-dimensional objects such as bottles or cans made, for example, of glass, plastic, and/or metal, have until now been labeled or printed using screen printing. For this, a direct digital decoration of the surfaces of the three-dimensional objects using inkjet print heads, which work on the drop-on-demand principle, has been possible for some time now.

The digital printing presses used for this are known in several embodiments. For one, there are the single printing presses (for quantitatively smaller output requirements), in which one object each is fixed and digitally printed. Further, there are the synchronized presses, in which a plurality of single printing presses are placed side by side, and several objects standing on one station each are printed simultaneously. In such synchronized presses, the output of the whole machine corresponds to the multiple of the individual output of a single station, each of which, in particular, can be equipped with single printing presses. A characteristic feature of the synchronized presses is the simultaneous change to several three-dimensional objects to be printed in the individual stations. Also, cyclically operating machines are usually designed such that the individual inks or colors to be printed are printed one after the other in successive stations. As a rule, the output of such a synchronized press is limited by the speed of a print head, which specifies the time for the printing on a three-dimensional object. This time determines the cycle time significantly.

Besides these, there are also solutions which enable significantly higher outputs (in terms of quantity) than synchronized presses. There are two embodiments known for this. One groups together complete single printing presses, in which the entire printing is done on one station, side by side, on a carousel. The other reproduces the output of one or more colors through a plurality of single printing stations for each color on a separate carousel each. Such types of machines are described as carousel machines, in which the (cycled printing in itself) is done in single printing presses of a rotating carousel. This enables continuous handling of the three-dimensional objects to be printed.

One thing common to all the solutions is that the printing of a logo or a security feature using special inks is not possible, or is possible only to a limited extent, because these special inks are mostly not suitable for printing using inkjet print heads.

Often, such an overprint on such decorations is, however, necessary, which has to be done using special inks, such as for example, the application of a deposit logo in the case of non-returnable containers for beverages in Germany. As a rule, such inks are security inks, which guarantee protection against counterfeiting, and are not suitable for processing in inkjet print heads due to their structure. Such prints are, as a rule, made on the girth circumference of a three-dimensional object, such as a non-recyclable bottle or can, since they must be non-detachable. As a rule, such logos or special prints are standardized and are not subject to any frequent changes in the print design, unlike digital printing, which is designed for variable data and decorations.

The question of a solution for three-dimensional objects, which are digitally decorated, did not arise, due to the usage, until now, of labels or sleeves, which are produced in offset printing, gravure printing or flexographic printing. Nevertheless, it may be required to provide basically digitally decorated or printed three-dimensional objects additionally with an overprint, which requires the application of non-inkjet printing capable printing inks.

The DE 10 2007 020 635 A1 describes the use of security ink in an identification system for an object.

The DE 29 38 026 A1 discloses a pad device with a matrix printer as a fixed pad element.

WO 03/106177 A2 discloses a device for machining the surface of parts with a plurality of different machining stations, at which different machining processes are carried out. The machining processes comprise a printing of the parts using inkjet print heads, as well as using screen printing, offset printing, flexographic printing, or gravure printing processes. Besides this, the device has a rotary transfer machine configured as a conveying unit, which conveys the parts to the predefined desired positions at the stationary machining stations. After conveying, the rotary transfer machine is at a standstill for the duration of machining on the parts. After the machining, i.e., in cycles, the rotary transfer machine is then rotated further, to handle the next part in the respective machining station.

From WO 2009/018892 A1, different devices for printing of containers are known. One device describes a direct printing of the container with inkjet print heads, which can be connected or disconnected for the partial printing, wherein an inkjet print head can be moved out of the printing position and another print head can be moved into the printing position. WO 2009/018892 A1 also discloses a device different from this for printing containers using a transfer printing, in which the printing is done using inkjet print heads on transfer pads (and not directly on the container), which transfers the image by rolling off on the respective container. In the process, the transfer pads and the containers are moved at different speeds, which roll off the transfer pads onto the surface of the containers.

In US 2009/0205516, a process is disclosed for the direct printing of bottles using inkjet printing, wherein variations in the bottle dimensions due to manufacturing tolerances are reconciled by determining the dimensions of the bottles and calculating the correction values for the control.

In DE 10 2013 208 061 A1, a device of the generic kind for printing containers is described.

SUMMARY

In an embodiment, the present invention provides a printing press for digital printing on three-dimensional objects. The printing press is configured as a carousel press which includes a plurality of printing stations arranged in a specified radian on an outer peripheral edge of a press wheel. Each one of the printing stations includes at least one inkjet print head for digital printing on three-dimensional objects and a rotary table for holding the three-dimensional object. The rotary table is configured to place the object in front of the inkjet print head and to rotate about its own axis such that a surface of the three-dimensional object to be printed is passed onto the inkjet print head for digital printing. The press wheel rotates with the printing stations at a predetermined circumferential speed while printing on the three-dimensional objects. At least one printing unit is configured to print on the three-dimensional object by separate printing of a mark or a logo executed as a pad print. The at least one printing unit includes a mechanical feed unit configured to press the pad onto the three-dimensional object to be printed following a triggering signal, and a plurality of pads successively arranged on a rotating wheel. The rotating wheel is arranged and adapted to rotate past the three-dimensional objects to be printed in the printing press such that the pads touch the surface of the three-dimensional objects to be printed. The pads arranged on the rotating wheel of the printing unit and the surfaces of the printed three-dimensional objects held in the printing stations of the carousel press which are arranged on the press wheel are held in the same radian and move at the same circumferential speed so that the pads print on the three-dimensional objects, each one of which is arranged on a peripheral edge of the successive printing stations, by a tampograph.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
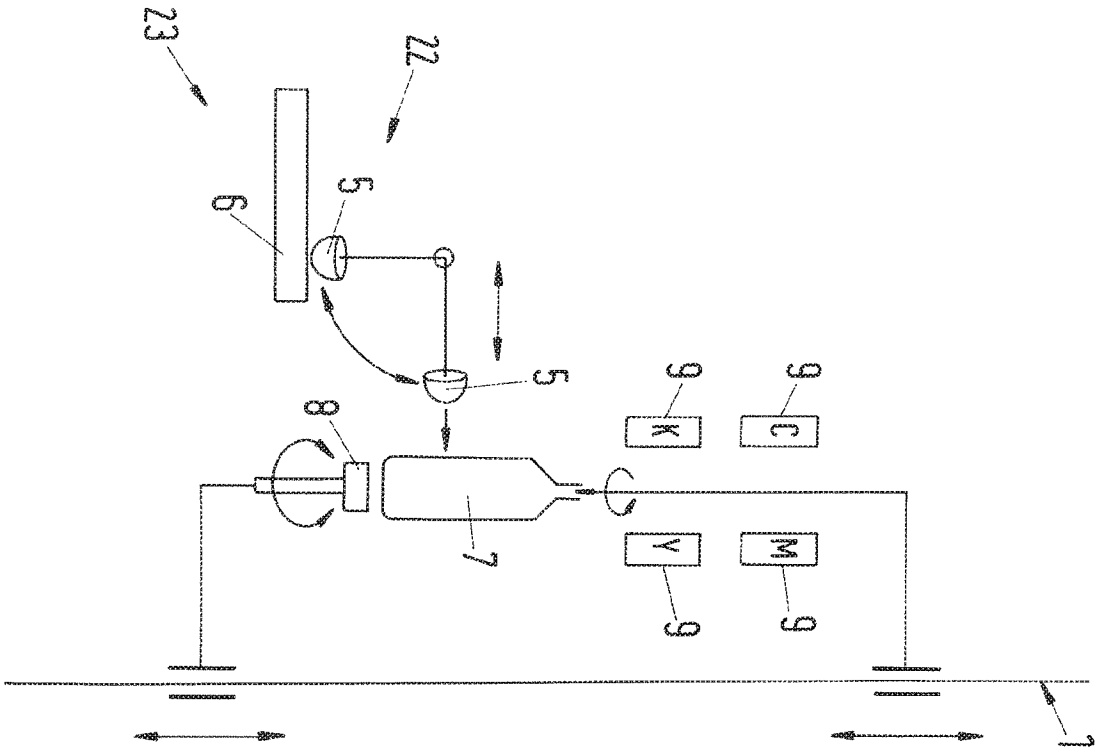
FIG. 1. A known printing press, configured as a single printing press.

In an embodiment, the present invention provides a way of providing such digitally decorated objects in high-volumes with overprints, which require non-inkjet printing capable printing inks.

In an embodiment, it is provided in particular that the printing press has at least one printing unit with at least one pad for printing the three-dimensional object by means of a separate print of a marking or a logo configured as a tampograph. According to an embodiment of the present invention, it is therefore proposed to apply such prints or logos, for which a special ink is necessary, through a tampograph. Thus, a tampograph in combination with digital printing is proposed. With such a complex solution it is possible to not only achieve the high required volumes of up to 20 tampographs per second, but also to achieve a dimensionally accurate, high-quality overprint. The transfer of the special color onto the object by means of tampograph is not subject to the limitations regarding pigment size or other criteria for inks for digital print heads.

Accordingly, in an embodiment of the present invention, an inking device is also provided in the printing unit, with which the ink is applied or can be applied on the pad. In a classic pad with a raised, dimensionally stable, printing plate which forms the motif to be printed, the inking device may be an ink pad onto which the pad is pressed to pick up the ink. Alternatively, a controlled inking roller can also be considered. With both the solutions, the ink can be applied at the speed required for the high volumes.

The terms "pad" and "tampograph" in this description also include the terms "tampon" and "tampon printing", besides a classic pad or tampograph. While a pad in the classic sense forms a raised, dimensionally stable printing plate with the motif to be printed, which is moved up onto an ink pad for the application of ink, and in the process picks up the ink corresponding to the raised printing plate, a tampon is an elastic printing body, which is placed on a printing plate (in the sense of a die) filled with ink for the application of ink, in which the motif to be printed forms a cavity filled with the ink. When placing the tampon onto the printing plate, the tampon picks up the ink in the area of the motif to be printed. The pad as well as the tampon are then pressed onto the surface of the object to be printed in order to reproduce the desired motif. Here, the tampon has the advantage that, owing to its elasticity, it can be better adapted to the form of the object to be printed. The principle of the printing is basically the same, insofar as a color impression corresponding to the motif to be printed is applied to the pad or tampon and then transferred onto the surface of the object to be printed. In the present disclosure, this printing principle is described as tampography with a pad, and it includes the printing with a pad in the classic sense as well as with a tampon.

In tampon printing, the inking device is configured accordingly as a die (printing plate) with a filling device, wherein the filling device fills the cavity representing the motif to be printed with ink and keeps the area of the die without a cavity free of ink. For this, for example, an inking roller of the filling device can be rolled with the ink over the die, and the ink that is not held in the cavities can be stripped off the surface of the die with a scraper. Accordingly, the filling device can comprise the inking roller and the scrapper for this purpose, which are configured to be guided over the die, and thus the ink fills in only the cavities of the die.

The printing press is set up for the tampograph to align the three-dimensional object in front of the pad by means of actuators, such that the printing takes place on a pre-defined spot of the three-dimensional object. For this, it can be provided that the actuators are set up to position the three-dimensional object to be printed in front of the pad. The proposed actuators can have setting options for all axes, so that the three-dimensional object can be freely adjusted in terms of orientation, position, and/or height in front of the pad of the printing unit. The positioning is done such that the tampograph printing takes place at a predefined spot on the surface of the three-dimensional object.

Preferably, the actuators interact with the rotary table, on which the three-dimensional object is picked up during the digital printing with at least one inkjet print head. The actuators can be configured to move the rotary table directly, axially upwards, and downwards and rotate it. In this embodiment, the rotary table is configured to place the object for the tampography process in front of the pad. If required, an actuator can also perform a radial adjustment of the axis of the rotary table.

To carry out the printing, the printing unit has mechanical feed unit, which is set up to press the pad onto the three-dimensional object after a triggering signal. This is an easy-to-implement model for the printing unit, which requires less space in the area of the inkjet print heads, and that is why it can be combined especially well with equipment for digital printing in a printing station.

In a particularly preferred further development, the mechanical feed unit can have a mechanism particularly configured as an adjustable cylinder, i.e., linear adjusting, which presses the pad onto the surface of the three-dimensional object. An alternative to an adjustment cylinder as feed unit is the rotating wheel, provided according to the present invention, on the circumferential edge of which the pad is mounted such that the pad touches the three-dimensional object during the rotation of the wheel and runs the tampograph in the process. During the rotation, the pad can also rotate past a suitably configured inking device, so that ink is applied to the pad while it is rotating past.

In this case, the printing unit has a plurality of pads, which are arranged on a rotatable wheel, on the circumferential edge of this wheel, wherein the wheel is arranged and set up to rotate past the three-dimensional objects to be printed in the printing press such that the pad touches the surface of the objects to be printed. In this way, a continuous process is achieved, in which each pad prints one or more objects. By having different printing inks in the successively arranged pads, if required, two or multiple color printing can also be achieved. A pad on the rotating wheel always prints the object, which is currently in the printing position in the printing press, past which the pad is rotating. If required, it is also possible to provide a printing press with continuously conveyed objects for a (quasi) continuous tampography process, wherein the objects are successively printed by the pad arranged on the wheel.

According to an embodiment of the invention, the printing press is preferably set up for carrying out the tampography process after executing the digital printing, so that the tampography can be done or is done on already digitally-printed surfaces as well. Single printing presses or stations of printing presses with a plurality of single printing presses, each of which having at least one inkjet print head and one printing unit with a pad, are in this sense, preferably set up, firstly, to carry out the digital printing and after that, to apply an additional tampograph (also in the sense: tampon printing). To do this, the three-dimensional object is aligned—without taking it out of a clamping/setting on a rotary table—in front of the pad by means of suitable adjusting devices, such as servo motors, in such a way that the tampograph can be applied at the intended position. In the process, according to an embodiment of the present invention, in a single printing press, the pad can be pressed onto the object's surface by means of a mechanism, e.g., through an adjustable cylinder, and thus an appropriate impression can be created.

According to an embodiment of the present invention, the printing press is configured as a carousel press with a plurality of printing stations, which rotate along on the external circumferential edge of the press wheel, i.e., on the press wheel, are arranged in a predefined radian measure, preferably equidistant, and are each configured as single printing presses for digital printing of three-dimensional objects with at least one inkjet print head or several inkjet print heads and a rotary table for receiving the three-dimensional object, wherein the press wheel rotates with the printing stations while printing the three-dimensional objects always at a preferably constant, predefined circumferential speed.

A single printing press of a printing station for digitally printing three-dimensional objects at a printing station of the printing press thus corresponds in its structure and function to the printing press described in the preamble, wherein the carousel press has a plurality of these single printing presses on a preferably, continuously rotating press wheel. The printing press configured as a carousel printing press is set up such that during the rotation of the press wheel, the digital printing of the three-dimensional object is carried out in one or each of the single printing presses. The digital printing is done between an infeed device, with which the three-dimensional objects are fed into a single printing press of the printing press, and a discharge device, with which the three-dimensional object is again taken out of the single printing press of the printing press. The tampograph printing then takes place between the infeed device and the discharge device.

In one embodiment, each single printing press at a printing station of the printing press can have a printing unit described earlier with a pad for printing the three-dimensional object by means of tampography process.

In particular, in continuously running carousel presses, a provision can also be made to configure the tampograph continuously, and not cyclically, through the forwards and backwards moving mechanical positioning systems already mentioned by way of example. According to an embodiment of the present invention, this is achieved by the fact that the pads are arranged on the rotatable wheel of the printing unit, and the surfaces to be printed of the three-dimensional objects received in the printing stations of the carousel press are arranged on the press wheel with the same radian measure, i.e., an identical or similar radian measure with preferably less than 10% deviation, and they move at the same circumferential speed, in particular, at an identical or similar circumferential speed, preferably less than 10% deviation, so that the pads arranged successively on the rotating wheel print the three-dimensional objects arranged at the circumferential edge in the consecutive printing stations by means of tampography upon contact of the surfaces of the three-dimensional objects with the pads. Since the pads on the rotatable wheel move with the same circumferential speed as the press wheel of the carousel press, the three-dimensional objects are thus printed in the single printing presses of the printing stations of the carousel press one after the other by the next pad.

According to an embodiment of the present invention it is thus proposed that, at the circumscribed circle of the outer contour of the surface to be printed, another wheel be arranged, which is operated with the same or almost the same circumferential speed as the carousel. The drive will thus be synchronized with the carousel. According to an embodiment of the present invention, the plurality of pads is arranged on this wheel, which are arranged in the same or almost the same division as the objects to be printed at the circumference of the carousel in the printing stations. This wheel with the pads is either connected with the digital printing press or pushed up to the digital printing press in such a way that the pads adequately touch the surface of the three-dimensional objects for printing in order to carry out the tampograph printing.

Ideally, the wheel has the same radian measure between the pads or the tampons as the objects on the digital printing press. This would, however, result in different radian measures in the case of different-sized circumscribed circles to be printed of three-dimensional objects to be printed, which arises when, for example, objects of varying diameters on their outer side are to be stamped. According to an embodiment of the invention, this varying radian measure could be reconciled through suitable format parts for every object diameter. However, the assembly and alignment of such format parts are expensive.

Instead of the usage of format parts, according to a particularly preferred further development of the present invention, it is therefore proposed that the radian measure between two consecutive pads should lie between a minimum and a maximum radian measure, which gives the minimum expansion (minimum radian measure) between the surfaces to be printed of the three dimensional objects in two consecutive single printing presses for three-dimensional objects and the maximum expansion (maximum radian measure) for three-dimensional objects. Preferably, the radian measure between two consecutive pads corresponds exactly to the mean between the minimum radian measure and the maximum radian measure. If one sets this radian measure as the division of the pad, then, in case of a smaller or greater radian measure, a relative movement—also called a slip in the following—will occur on the digital printing press between the pad and the object surface to be printed, which is once positive and once negative, depending upon the expansion of the three-dimensional object (greater or smaller than the mean). According to an embodiment of the invention, it was found that this slip can be tolerated, as it is usually a fraction of the print width of a logo in the tampograph. This is explained in the following based upon a concrete example, without the described concept being restricted to exactly this concrete example.

The radian measure of the outer contour of an object on a printing press with 48 stations and 2.3 m pitch diameter fluctuates between 157.08 mm and 153.80 mm on printing of, for example, three-dimensional objects having 50 to 100 mm diameters. The mean is therefore 155.44 mm. Since a typical logo in the tampograph (i.e., as defined in the beginning in the "classic" tampograph or in tampon printing) has a size of approx. 9 mm print width, the path to be printed is therefore 5.7% of the radian measure.

The difference between the movement of the mean value on the pad wheel (i.e., the rotatable wheel with the plurality of pads) and the three-dimensional object on the carousel printing press during the tampograph printing is therefore approx. 5.7% of the difference between the two radian measures in the case of three-dimensional objects with the largest and smallest diameters, i.e., maximum and minimum expansion. This difference in radian measure in the numerical example results in an absolute, that is, to approx. 1.63 mm, and the approx. 5.7% of this is 0.09 mm—that is, less than 1/10 mm. This difference can be ignored according to the present invention; so, it is possible to print all the different object sizes of the three-dimensional objects in the tampograph with a single division of the rotatable wheel with the plurality of pads (pad wheel).

Nevertheless, according to a further development of the present invention, it is suggested that the slip be reduced or avoided. For this, it can be provided that the actuators for positioning the three-dimensional object to be printed in front of the pad are set up to move the three-dimensional object during the tampograph printing in or against the direction of the surface to be printed of the three-dimensional object, that is, in the case of a carousel press, in or against the circumferential direction of motion of the press wheel of the carousel press. Through this, the printing path distance is lengthened or shortened and simultaneously, in case of object diameter of the three-dimensional objects deviating from the mean value, a quasi-rolling off movement, as in gears, is achieved between the pads and the surface to be printed of the three-dimensional object.

According to an embodiment of the present invention, this can be accomplished in a particularly simple way by setting up the actuators for positioning the three-dimensional object to be printed in front of the pad to move the three-dimensional object during the tampograph printing by defining the direction and the speed of the movement of the three-dimensional object in such a way that the circumferential speed of the surface to be printed of the three-dimensional object corresponds to the circumferential speed of the pad on the rotatable wheel. For this, in a simple way, the rotary table, on which the object stands and which is driven by a servo motor or another suitable, variable speed motor, can accordingly be rotated during the tampograph printing in order to lengthen or shorten the printing path distance. For this, the motor of the rotary table, on which the three-dimensional object stands, is rotated in or against the circumferential direction during the tampograph printing or tampography process. With that, the circumferential speed of the object's surface to be printed is either increased (if rotated in the circumferential direction of the carousel press) or slowed (if rotated against the circumferential direction of the carousel press). With that, according to an embodiment of the present invention, there is a possibility of matching the circumferential speed of the pad or the tampon and the surface to be printed to each other.

According to an embodiment of the present invention, a control unit can be provided for controlling the digital printing and the tampograph, which controls the components of the printing press according to the invention in the described manner. For this, the control unit has a processor device, which is configured, in particular, using suitable programming code tools for execution of the single control steps. In view of the above-described application, the control device is set up also for determining the rotation of the three-dimensional object according to the calculation described by way of example, to determine and accordingly set the circumferential speed of the surface to be printed of the object. For this, the expansion of the three-dimensional object is also known, preferably through a relevant input and/or detection by means of a sensor—for example, a camera.

There are also printing presses, which are configured as a synchronized printing press, in which a plurality of rotary tables are arranged in a specified radian measure, preferably equidistant, on a rotatable press wheel, and a plurality of printing stations are arranged in front of the outer circumference of the press wheel at a distance corresponding to the specified radian measure of the rotary table, such that in a turning position of the press wheel, one rotary table each is arranged in front of a printing station, wherein a plurality of printing stations have at least one inkjet print head for digital printing and at least one printing station has a printing unit with a pad for executing the tampography process. In synchronized presses, in which several single stations are arranged side by side, each station can have its own pad. In the case of synchronized presses, which apply different colors in the digital printing one after the other in different printing stations, it is proposed that the printing unit for the tampograph be arranged in one of the printing stations with the digital color print, preferably the last printing station with the color print, or in a separate printing station. The separate printing station is preferably subordinated to the printing stations for the digital printing. In this arrangement, the tampograph can be made in a synchronized press with only a little additional expenditure of time.

It would be conceivable and advantageous, according to the present invention, to also re-orient the three-dimensional objects after leaving the synchronized press and subsequently print them in a pad printing process, because the tampography process requires only a fraction of the time (processing and printing time) compared to the digital printing. This is especially advantageous in the case that the printing press can have a separate machine part for the digital printing and a separate machine part for the tampograph—for example, because there is space for such an arrangement in the processing line. Then, this solution can be integrated in a particularly simple manner into an existing system, and the tampograph can be extended without reducing the usual cycling rate. If required, several stations with tampographs can also accordingly be arranged one after the other in a synchronized press, in order to achieve the desired cycling rate.

A printing unit can also be integrated into the machine part of the printing press, in which the inkjet print heads are located. According to an embodiment of the invention, the printing unit is integrated in another machine part of the printing press, which is different from the machine part with the inkjet print heads (9). This makes it possible to carry out the tampography process either directly following the digital printing process in the machine part of the printing press with the inkjet print heads itself or in a downstream machine part and, for example, to apply the desired logo with the pad. In the second case, the tampograph can also be decoupled from the digital printing in terms of time—if required, even detached from a carousel arrangement of the printing press for the digital printing. In other words, the three-dimensional objects can be brought from one machine part of the printing press having the inkjet print heads to another machine part having the tampograph printing unit through a suitable conveyor.

Due to the flexible design option and the elastic form, which adapts to the form of the surface to be printed of the three-dimensional object (within the limits of the existing elasticity), it is particularly advantageous if the printing unit has a tampon—in the sense of a structure-less, elastic printing body—as a pad that picks up the ink by pressing on a die—also referred to as printing plate—in which a cavity filled with printing ink for the desired print image is provided. Thus, by replacing the dies, the motif or the logo of the tampograph can also be easily changed.

A preferred usage of the printing press according to the invention provides for the use of the tampograph for such overprints, which cannot be achieved with the inks that can be used in the inkjet print heads. This applies in particular to the security applications, in which the authenticity of the overprint is determined through certain contact-less, measurable properties, particularly using sensors. In this case, according to the present invention it can be provided that the printing ink for the tampograph is a security ink, which cannot be processed in the inkjet print heads in terms of pigment size and/or other characteristics, such as flow properties or the like.

To switch on and switch off the application of a tampograph on a three-dimensional object easily, besides a direct control of the pad, it can also be provided according to the present invention that the printing unit has an inking device with a controllable mechanism, which is set up to retract the inking device when no three-dimensional object is to be printed. This can be provided, for example, when there is no three-dimensional object present in the printing station for the tampograph or there is no print command present for the special three-dimensional object in the printing station. With that, it is thus proposed according to the present invention, to provide the pad with printing ink, only if a print is really to be made. Whenever there is either no three-dimensional object present in the printing position for the tampograph or such an object is not to be printed for whatever reasons, no printing ink is applied on the pad. In the case of a tampon as pad, the inking device that provides the die with printing ink, from which a tampon picks up the ink, can be retracted mechanically for a short time for the ink transfer, so that the die remains without ink. To do this, an inking roller can be retracted by a short path. Such a movement can be realized technically without difficulty by means of a cam disc or via a servo drive. In the classic pads, the die rollers are omitted, and the inking roller applies directly on the pad. The same applies here in above described method. Then, the inking roller opposite the classic pad, which should not get any inking, is retracted.

Further, according to an embodiment of the present invention the printing press has a common drying and/or hardening device, which hardens or dries together the printing ink of the inkjet print heads used for the digital printing and the printing ink used for the pad printing, e.g., UV light. The pad ink will then be hardened or dried together with the digital printing ink.

In FIG. 1, there is a printing press 1 configured as a single printing press shown schematically with components essential for an embodiment of the invention. The printing press 1 has four inkjet print heads 9 for the different printing colors such as Cyan (C), Magenta (M), Yellow (Y), and Black (K) and a rotary table 8 driven by means of an actuator for receiving a three-dimensional object 7, which is configured as a bottle in the embodiment shown. This application with a bottle 7 is particularly preferred according to an embodiment of the present invention.

The rotary table 8 with actuator is configured for placing the three-dimensional object 7 in front of the inkjet print heads 9 and to rotate on its own axis. During the rotation of the three-dimensional object 7 in front of the inkjet print head 9, the surface of the three-dimensional object 7 is digitally printed by known means. To do this, during the rotation of the object 7, drops of ink are sprayed when required on the surface (drop-on-demand process), so that the single ink drops result in the desired print image on the surface. In multi-color images, each inkjet print head 9 prints its color on a pixel of the surface. Mixed colors are created by printing different colors on the top of each other. In the arrangement shown, there are two inkjet print heads 9 each in one rotation level. A total print in four colors is created in this case, such that the rotary table positions and rotates the three-dimensional object one after the other in each of the two rotation levels in front of the inkjet print heads 9. The height adjustment is indicated through the two double arrows in vertical direction.

Diverging from such a structure, it is in principle also possible to arrange the inkjet print heads 9 in one rotation level, distributed around the three-dimensional objects 7, such that while rotating in this one rotation level, all the inks are pressed by the inkjet print head on the surface to be printed of the three-dimensional object 7.

The printing press 1 has, according to an embodiment of the present invention, additionally a printing unit 22 with a pad 5 for printing the three-dimensional object 7 by means of a separate print of a marking or logo configured as a tampograph. For this, the three-dimensional object 7 is aligned in front of the pad 5 by means of actuators such that the print is done on a pre-defined spot of the three-dimensional object 7, wherein the pad 5 is pressed by the printing unit 22 onto the surface of the object 7. The object continues to be present on the driven rotary table 7, which is accordingly positioned in front of the printing unit 22 such that the pad can be pressed onto the desired position of the three-dimensional object 7. This is indicated in FIG. 1 by the arrow pointing to the object 7.

Further, in the printing unit 22, there is an inking device 23 provided with which the printing ink is applied on the pad 5. In the example shown in FIG. 1, the pad 5 is configured as a classic pad with a raised, dimensionally stable printing plate, which forms the motif to be printed, which gets printed upon pressing the pad 5 on the three-dimensional object 7 in the tampograph. In this case, the inking device 23 can simply have an ink pad 6, also referred to as inking pad, on which the pad 5 presses by means of a mechanism. To do this, the pad 5 is mounted so that it can swivel in the example shown. Then, the same adjusting mechanism of the printing unit 22, with which the pad 5 is pressed onto the surface of the three-dimensional object 7, can also be used for pressing the pad 5 onto the ink pad 6 for applying the printing ink. This is shown in FIG. 1, in which a pad 5 is shown in the printing position in front of the three-dimensional object as well as in front of the ink pad 6, wherein the adjustment is indicated by the arrow between the two positions. In a real tampograph, these positions will be controlled one after the other.

The process of printing of the three-dimensional object 7 in printing press 1, according to the present invention, can proceed in such a way that an object to be printed 7 is placed on the rotary table 8 of the printing station 1 configured as single station and—in the diagram—moved upwards to the very top and placed between the inkjet printer heads 9. Through the rotation of the rotary table 8, the surface of the three-dimensional object is guided past the inkjet print heads 9 for digitally printing according to the drop-on-demand principle. After the digital printing, the object 7 on the rotary table 8 is again lowered by means of the actuator.

After lowering the object 7—for example in the initial position—in which the placement of the three-dimensional object 7 in the printing press 7 also occurs, the surface to be printed of the three-dimensional object 7 is rotated in front of the pad 5 by the actuator of the rotary table 8, and the pad presses on the object 7 through its mechanism, which is not drawn in detail. The pad 5 is subsequently pressed onto the ink pad 6 in order to be ready for the next pad printing process. Alternatively, this can also be done before a pad printing process.

By doing so, the digital printing, according to the present invention, can be combined with the tampograph in a simple printing press 1. According to an embodiment of present invention, it is also possible to arrange the printing unit 22 in the printing press 1 in the rotation level with a part of or with all inkjet print heads 9.

Figure 2:
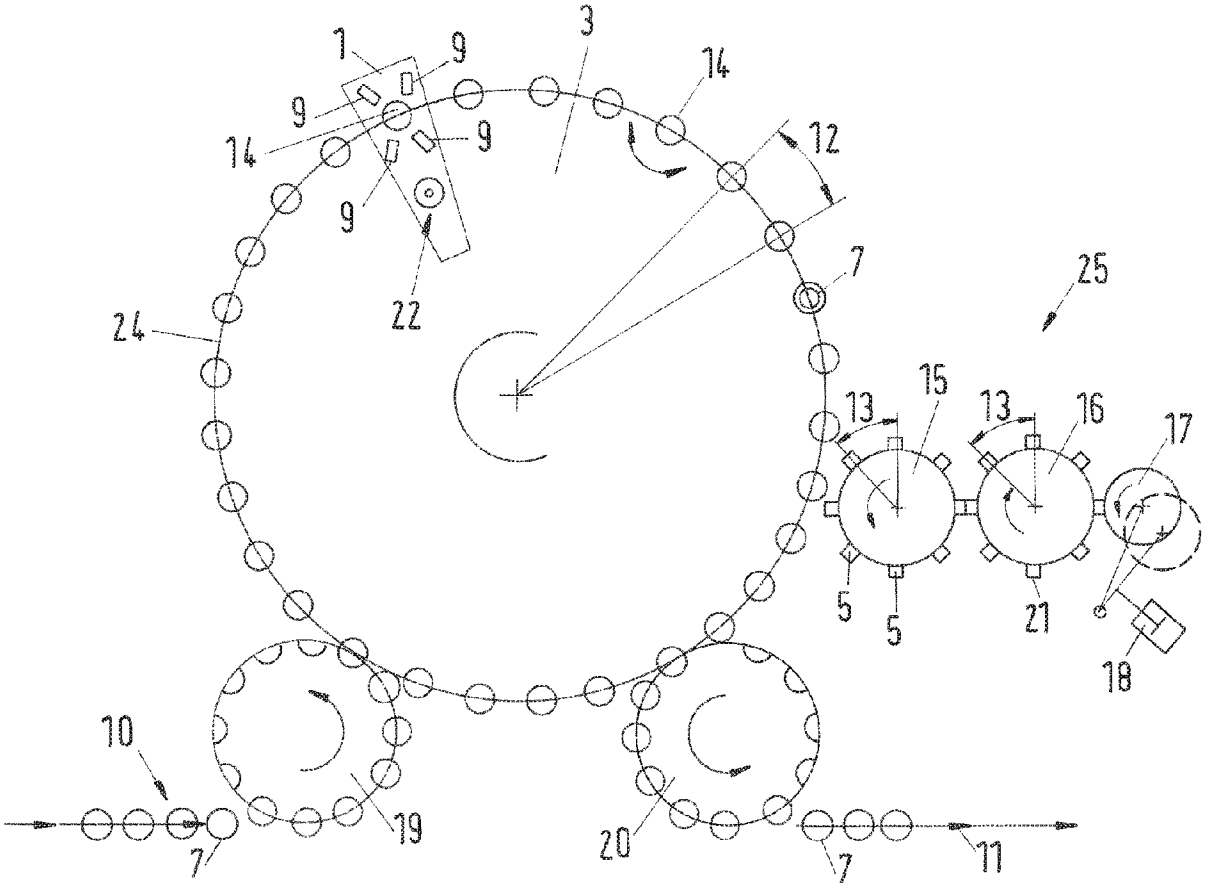
FIG. 2 A printing press configured as a carousel printing press according to one embodiment of the invention, wherein a single printing press according to FIG. 1 can be arranged at the printing stations of the carousel printing press.

In FIG. 2, a further embodiment of a printing press 3 according to the present invention is shown, which is configured as a carousel press with a plurality of printing stations. The single printing stations are configured on a rotating press wheel 24. For this, on each printing station, the single printing presses corresponding to the printing press 1 are arranged. One of these single printing presses 1 is drawn in the FIG. 2, wherein there is a rotary table 14 corresponding in its essential functions to the rotary table 4 in FIG. 1, four inkjet print heads 9 arranged in a rotation level around the rotary table 14, as well as a printing unit 22 with pad 5 provided, which also lies in one rotation level. The term "one rotation level" means that the rotary table 14 is arranged in an axial position, and the digital printing as well as the tampograph of a three-dimensional object 7 received and rotating on the rotary table 14, takes place in this level.

The single printing stations with the single printing presses 1 are each arranged on the outer circumferential edge of a press wheel 24, rotating along with the press wheel 24 and in a specified radian measure 12, preferably equidistant. For the sake of simplicity, in the schematic representation according to FIG. 2, the single printing stations are represented by the diagram of the rotary tables 14, which are arranged in a radian measure 12 of the division of the press wheel 24 of the carousel. On a rotary table 14, by way of example, a bottle 7 is drawn as a three-dimensional object 7.

In the known manner, the placing of the three-dimensional object 7 on the printing press 3 takes place by means of an infeed star shaft 19 as infeed device. Accordingly, a discharge star shaft 20 is provided as a discharge device, with which the three-dimensional objects 7 are again removed after the processing on the printing press 3. The infeed star shaft 19 and the discharge star shaft 20 are arranged tangentially at the press wheel 24 of the printing press 3 and are connected via an object infeed 10 and object discharge 11 respectively to a conveyor system for the three-dimensional objects 7.

The process of the handling is as follows: The three-dimensional objects 7 move via the infeed star shaft 19 on the continuously rotating carousel or the printing press 3, on which the stations for the single printing presses 1 with inkjet print heads 9 are evenly spaced. As a rule, all single printing presses 1 are mounted. During the infeed of the objects 7 from the infeed star shaft 19, the objects 7 in the single printing press 1 are placed on the rotary tables 14, which are driven by a motor, which can be seen in FIG. 1 in the rotary table 8. The digital printing takes place as described in the reference to the embodiment according to FIG. 1, while the single printing press 1 rotates further continuously on the press wheel 24 of the printing press 3.

Subsequently, the objects 7, as described in the embodiment according to FIG. 1, are aligned for the tampograph. After the tampograph process, the completely printed objects are then again removed from the printing press 3 via the discharge star shaft.

According to the first design of the embodiment according to FIG. 2, the tampography can be done by means of the printing unit 22, which works as described for FIG. 1. In this case, such a printing unit 22 is integrated into each single printing press 1 of the printing press 3.

A second design of the tampograph is also shown in FIG. 2, without necessarily having to combine the two designs with each other. In this second design, according to an embodiment of the present invention, the printing unit 22 can be omitted in the single printing presses 1 of the printing press 3. In such a case, the single printing press 1—in an otherwise identical structure—can therefore be configured even without the printing unit 22. Instead of this, the printing press 3 has a printing unit 25 for the tampograph, which is stationary and adjacent to the press wheel 24—i.e., not rotating with the press wheel 24 of the printing press 1—arranged in such a way that a pad 5 touches a three-dimensional object 7 received on the rotary table 14 in a turning position of the press wheel 24 and carries out the tampography process. Through this, every three-dimensional object in a single printing press can be printed with the tampograph by the printing unit 25 during the rotation of the press wheel 24.

To do this, the printing unit 25 has a rotatable wheel 15, also referred to as a pad wheel, on the circumferential edge of which a plurality of pads 5 are configured. The rotatable wheel 15 is arranged and set up to rotate past the three-dimensional objects 7 to be printed in the printing press 3 in such a way that the pads 7 touch the surfaces of the objects 7 to be printed at the position of the surface facing radially outwards with reference to the printing press 3. Along with the press wheel 24 (carousel) of the printing press 3, the rotating wheel 15 turns at the same circumferential speed, wherein two successive pads 5 on the pad wheel 15 are spaced by the same arc length 13 (radian) in the ideal case at constantly identical arc length 12 (radian) between the two three-dimensional objects 7 to be printed in successive printing stations. This allows execution of a tampograph during continuous operation of the printing press 3, i.e., continuous rotation of press wheel 24.

The three-dimensional objects 7 to be printed in the printing press 3 can be extended differently, i.e., protrude radially from the center of the rotary table 14 at different widths (relative to the printing press 3). If the object 7 is larger than a mean value between a maximum and a minimum expansion of the (different) three-dimensional objects 7 to be printed on the printing press 3, then its radian 12—namely, the circumferential speed—is slightly greater than the radian 13 and the circumferential speed of the wheel 15 (pad wheel) with the pads. This can be neglected in most cases, but according to an embodiment of the invention, it may be proposed to correct this in case of greater deviations with the drive of the rotary table 14 by turning this either against the circumferential direction of rotation of the carousel 3 for deceleration or along the circumferential direction of rotation for an intentional faster circumferential speed of the object 7. This has already been explained with an example.

In the illustrated example of the printing unit 25, this is configured with the above-explained tampons as a pad 5 on the rotating wheel 15 (pad wheel). These tampons attain their form to be printed (or the design to be printed) by matrices 21, which are also referred to as printing plates, are mounted on a matrix wheel 16 with the same pitch 13, and are driven together with the rotating wheel 15 (pad wheel) with the tampons. These matrices 21 are applied with ink by an inking roller 17, which is also driven synchronously with the matrix wheel 16 and the pad wheel 15. A mechanism 18 for retracting the inking roller 17 is provided when no three-dimensional object 7 needs to be printed with the tampograph, because such an object 7 is absent in the respective printing station of the printing press 3, or no print command is issued for the object 7 present there. If ink is not applied on the matrix 21 and/or the pad 5, a tampograph is not printed on the object. In a pad 5 configured as a classic pad, the matrix wheel 16 with the matrices 21 is absent, since classic pads have the information to be stamped incorporated in their design.

In the absence of an object 7 or the command to not stamp an object 7, the inking roller 17 is retracted by the retraction mechanism 18 as long as it is in contact with the corresponding matrix 21 (or the pad 5 on the pad wheel 15), so that the corresponding matrix 21 (or of the corresponding pad 5) is turned idly without application of ink. Then, the inking roller 17 pivots back to the subsequent matrix 21 or the subsequent pad 5 for the application of ink, if it were to be applied with ink.

Both embodiments, i.e., the first embodiment with the printing unit 22 and the second embodiment with the printing unit 25, both of which are shown in FIG. 2, can be used individually or in combination according to the invention.

Figure 3:
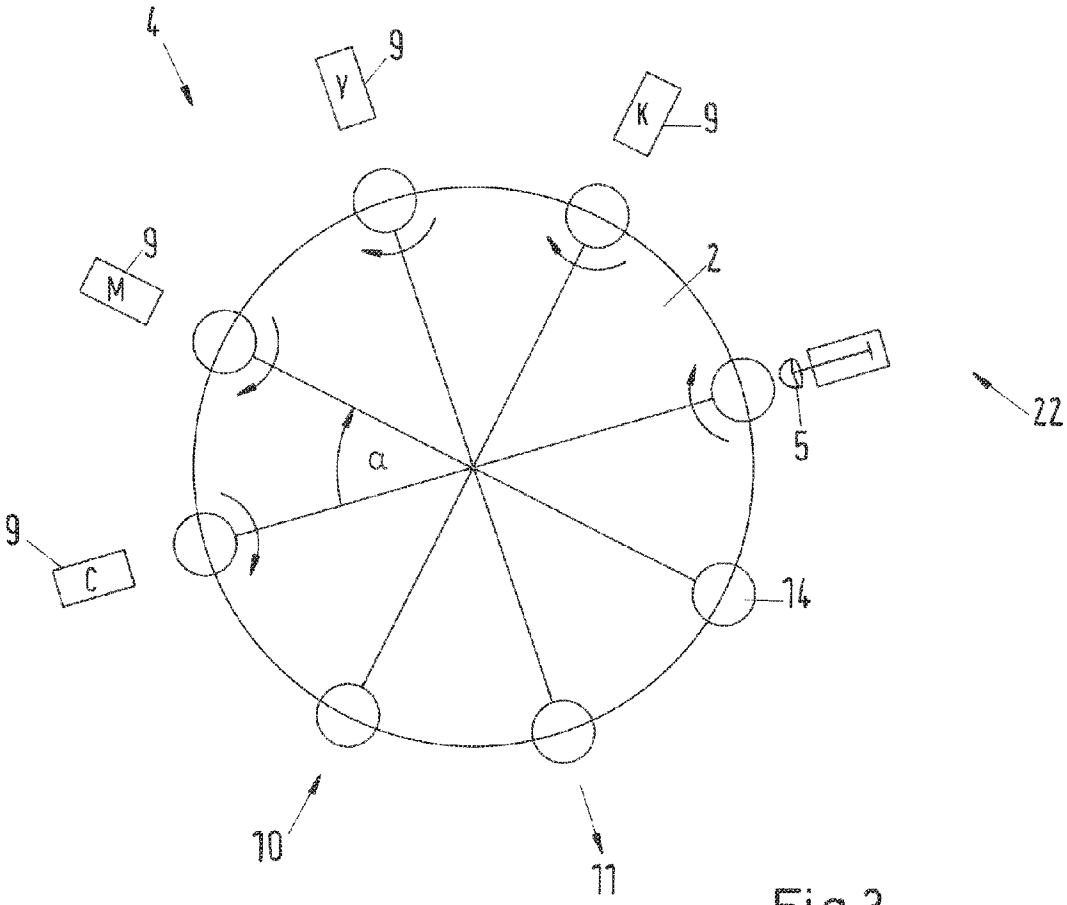
FIG. 3 A known printing press configured as a synchronized press with stationary, non-revolving print heads and a printing station for the tampograph.

Finally, as a further embodiment of the invention, FIG. 3 shows a synchronized press as a printing press 4, in which a plurality of rotary tables 14 are equidistantly arranged in a specified radian on a rotating press wheel 2, and a plurality of printing stations are arranged in front of the outer periphery of the press wheel 2 in a specified radian on the rotary table 14, such that a rotary table 14 is arranged respectively in a rotary position of the press wheel 2 before the printing station, wherein a plurality of printing stations comprise at least one inkjet print head 9 for digital printing, and a printing station comprises a printing unit 22 with a pad 5 for carrying out the tampography process. The feed and discharge are via an object infeed 10 and an object discharge 11.

In a cyclically operating printing press 4, in which a different process step, for example, a print or a non-illustrated process step such as a drying, takes place in each printing station, following the object infeed 10, there are several successive printing stations with the inkjet print heads 9, to which the three-dimensional objects 7 are successively conveyed on the rotary tables of the press wheel 2 at an angle $\alpha$. After completion of the digital printing, the object 7 is then aligned on the rotary table 14, on which it stands, such that the area to be printed is positioned before the pad 5 of the printing unit 22 in the printing station. A tampography is done using the pad 5, before the object is removed again from the press 2 through the object discharge 11.

As in the entire description of the various embodiments, the pad 5 may be configured as a classic pad for the classic tampograph or as a tampon for tampon printing.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 Printing press
2 Rotating press wheel
3 Printing press
4 Printing press
5 Pad
6 Stamp pad
7 Three-dimensional object configured as a bottle design
8 Rotary table with actuator
9 inkjet print head
10 Object infeed
11 Object discharge
12 Radian of the division at the carousel
13 Radian of the division at the pad wheel
14 Rotary table
15 Rotating wheel
16 Matrix wheel
17 Inking roller
18 Mechanism for retracting the inking roller
19 Infeed star shaft
20 Discharge star shaft
21 Matrix
22 Printing unit
23 Inking device
24 Press wheel
25 Printing unit

The invention claimed is:

1. A printing press for digital printing on three-dimensional objects, the printing press being configured as a carousel press and comprising;

a plurality of printing stations, which are arranged in a specified radian on an outer peripheral edge of a press wheel and each one of which comprises at least one inkjet print head for digital printing on three-dimensional objects and a rotary table for holding the three-dimensional object, wherein the rotary table is configured to place the object in front of the inkjet print head and to rotate about its own axis such that a surface of the three-dimensional object to be printed is passed onto the inkjet print head for digital printing, wherein the press wheel rotates with the printing stations at a predetermined circumferential speed while printing on the three-dimensional objects; and at least one printing unit configured to print on the three-dimensional object by separate printing of a mark or a logo executed as a pad print, the at least one printing unit comprising:

a mechanical feed unit configured to press a pad onto the three-dimensional object to be printed following a triggering signal; and a plurality of pads successively arranged on a rotating wheel, the rotating wheel being arranged and adapted to rotate past the three-dimensional objects to be printed in the printing press such that the pads touch the surface of the three-dimensional objects to be printed, wherein the pads arranged on the rotating wheel of the printing unit and the surfaces of the printed three-dimensional objects held in the printing stations of the carousel press which are arranged on the press wheel are held in the same radian and move at the same circumferential speed so that the pads print on the three-dimensional objects, each one of which is arranged on a peripheral edge of the successive printing stations, by a tampograph.

2. The printing press according to claim 1, further comprising actuators configured to position the three-dimensional object to be printed in front of the respective pad.

3. The printing press according to claim 2, wherein the actuators are arranged in front of the respective pad and are configured to move the three-dimensional object during the tampography along or against the direction of the surface of the three-dimensional object to be printed.

4. The printing press according to claim 3, wherein the actuators are configured to move the three-dimensional object during the tampography by determining a direction and speed of movement of the three-dimensional object, so that the circumferential speed of the surface of the three-dimensional object to be printed corresponds to the circumferential speed of the respective pad on the rotating wheel.

5. The printing press according to claim 1, wherein the mechanical feed unit includes a mechanism configured to press the respective pad on the surface of the three-dimensional object.

6. The printing press according to claim 1, wherein the radian between two successive pads is between a minimum radian and a maximum radian, which arise between printed surfaces of the three-dimensional objects in two successive single presses for three-dimensional objects of minimum extension and for three-dimensional objects of maximum extension.

7. The printing press according to claim 1, wherein the at least one printing unit comprises a tampon as the respective pad which absorbs the ink by pressing onto a matrix, which is provided with a recess that has a desired print image and is filled with ink.

8. The printing press according to claim 1, wherein the at least one printing unit comprises an inking roller configured to apply ink using a controllable mechanism, wherein the controllable mechanism is configured to retract the inking roller based on no three-dimensional object needing to he printed.

9. The printing press according to claim 1, wherein the at least one printing unit is integrated in another machine part of the printing press that is different from a machine part with the inkjet print heads.

10. The printing press according to claim 1, wherein the printing ink for tampography is a security ink, which cannot be processed in the inkjet print heads due to pigment size.

11. The printing press according to claim 1, wherein the printing press comprises at least one of a common drying device or curing device for digital printing and tampography.

* * * * *